US008616479B2

(12) United States Patent
Scholz

(10) Patent No.: US 8,616,479 B2
(45) Date of Patent: Dec. 31, 2013

(54) ROLLER MILL WITH DRIVEN GRINDING ROLLER

(75) Inventor: Guido Scholz, Münster (DE)

(73) Assignee: Polysius AG, Beckum (DE)

( * ) Notice: Subject to any disclaimer, the term of this patent is extended or adjusted under 35 U.S.C. 154(b) by 357 days.

(21) Appl. No.: 13/055,728

(22) PCT Filed: Aug. 24, 2009

(86) PCT No.: PCT/EP2009/060878
§ 371 (c)(1),
(2), (4) Date: Jan. 25, 2011

(87) PCT Pub. No.: WO2010/023183
PCT Pub. Date: Mar. 4, 2010

(65) Prior Publication Data

US 2011/0121117 A1 May 26, 2011

(30) Foreign Application Priority Data

Aug. 25, 2008 (DE) ..... 10 2008 039 541

(51) Int. Cl.
*B02C 15/00* (2006.01)

(52) U.S. Cl.
USPC ..... 241/119

(58) Field of Classification Search
USPC ..... 241/117–121, 101.2
See application file for complete search history.

(56) References Cited

U.S. PATENT DOCUMENTS

| | | | | |
|---|---|---|---|---|
| 4,896,837 | A * | 1/1990 | Heinemann et al. | 241/12 |
| 8,038,084 | B2 * | 10/2011 | Dilly et al. | 241/37 |
| 8,172,168 | B2 * | 5/2012 | Hoffmann et al. | 241/121 |
| 2009/0314866 | A1 * | 12/2009 | Hoffmann et al. | 241/120 |

FOREIGN PATENT DOCUMENTS

| | | |
|---|---|---|
| DE | 295563 C | 12/1916 |
| DE | 509212 | 10/1930 |

* cited by examiner

*Primary Examiner* — Dana Ross
*Assistant Examiner* — Leonel Vasquez
(74) *Attorney, Agent, or Firm* — Renner Kenner Greive Bobak Taylor & Weber

(57) ABSTRACT

A roller mill includes a grinding table arranged for rotation about a mill axis, at least one grinding roller rotated about a grinding roller axis and in rolling engagement with the grinding table, and at least one pivot lever retaining the grinding roller and having a pivot axis orientated parallel with or inclined relative to the grinding roller axis. A fixed motor is connected to the grinding roller via a drive train to transmit drive power, the drive train including a fixed drive train and a movable drive train. The fixed drive train has a drive element in contact with the movable drive train and arranged coaxially relative to the pivot axis of the pivot lever. The two drive trains may be connected to each other via two bevel wheels arranged so that the axes of the bevel wheels intersect in the pivot axis.

15 Claims, 4 Drawing Sheets

ROLLER MILL WITH DRIVEN GRINDING ROLLER

TECHNICAL FIELD

The invention relates to a roller mill having a grinding table which is arranged for rotation about a mill axis, at least one grinding roller which can be rotated about a grinding roller axis and which is in rolling engagement with the grinding table and at least one pivot lever for retaining the grinding roller.

BACKGROUND OF THE INVENTION

Various construction types of such mills are adequately known from practice and technical literature. Those roller or cylinder mills, which are also referred to as resilient force or external force mills, may be used, for example, for comminuting cement raw material, cement clinker, coal, ore materials and the like. There are provided inside a mill housing a grinding ring or grinding table which is arranged for rotation about the mill axis and which has a grinding path constructed thereon and a plurality of grinding rollers or grinding cylinders which are arranged so as to be distributed over the periphery of the grinding path and which roll on that grinding path. During the comminution work, the grinding material which is generally supplied to the grinding table or grinding ring centrally is comminuted on the grinding path between the grinding ring and the grinding rollers, with pressing members ensuring that a correspondingly large, generally adjustable grinding force is introduced in that region.

DE 509 212 discloses a roller mill having a pivot lever for rotatably retaining the grinding rollers, the pivot lever having a pivot axis which is arranged parallel with the grinding roller axis. The driving is brought about via the grinding table. However, those mills have the disadvantage that it is possible to bring about the great drive powers which are necessary for large mills with high throughputs only at very great expense.

DE 10 2006 061 328 A1 also sets out a roller mill, wherein the grinding table is driven and the grinding rollers are each retained on a pivot lever which has a pivot axis which is orientated parallel with the grinding roller axis.

DE 295 563 A further discloses an edge mill having a driven table and driven edge runner.

SUMMARY OF THE INVENTION

Therefore, an object of the invention is further to develop this type of roller mill (pivot lever mill) so that it is also possible to bring about high forces and high throughputs more cheaply.

According to the invention, this object is achieved by the features of claims 1 and 12.

The roller mill according to the invention comprises a grinding table which is arranged for rotation about a mill axis, at least one grinding roller which can be rotated about a grinding roller axis and which is in rolling engagement with the grinding table, and at least one pivot lever which is for retaining the grinding roller and which has a pivot axis, the pivot axis being orientated parallel with or inclined relative to the grinding roller axis. A fixed motor is further connected to the grinding roller via a drive train in order to transmit the drive power, the drive train comprising a drive train which is fixed in position and a drive train which is also movable with the pivot lever. The fixed drive train has a drive element which is in contact with the movable drive train and which is arranged coaxially relative to the pivot axis of the pivot lever.

According to another construction of the invention, the roller mill at least comprises a grinding table which is arranged for rotation about a mill axis, at least one grinding roller which can be rotated about a grinding roller axis and which is in rolling engagement with the grinding table, and at least one pivot lever which is for retaining the grinding roller and which has a pivot axis, the pivot axis being orientated parallel with or inclined relative to the grinding roller axis. A fixed motor is further connected to the grinding roller via a drive train in order to transmit the drive power, the drive train comprising a drive train which is fixed in position and a drive train which is movable with the pivot lever and the two drive trains being connected to each other via two bevel wheels, the bevel wheels being arranged in such a manner that the axes of the bevel wheels intersect in the pivot axis.

By at least the grinding rollers also being driven, it is possible to distribute the power for driving the roller mill over a plurality of grinding rollers and/or the grinding roller and the grinding table. It is thereby possible to use drives which are smaller and therefore cheaper.

The spacing between the grinding roller axis and the axis of the drive element during the pivot movement of the pivot lever does not change owing to the drive element which is arranged coaxially relative to the pivot axis. Consequently, reliable transmission of the drive power is ensured.

If the pivot axis is orientated parallel with or inclined relative to the grinding roller axis, it is possible to connect the two drive trains to each other via two bevel wheels which are then intended to be arranged in such a manner that the axes of the bevel wheels intersect in the pivot axis in order to ensure reliable transmission of the drive power.

The dependent claims relate to other advantages and constructions of the invention.

According to a preferred embodiment, the movable drive train has a toothed ring which is connected to the grinding roller and which is preferably connected to the drive element directly or via at least one intermediate wheel. The intermediate wheel is advantageously retained on the pivot lever. However, there may be provision for the drive element to be a drive wheel of a traction mechanism which is provided between the fixed drive train and the movable drive train. It is further advantageous if at least the drive element and/or elements of the movable drive train are constructed for pivoting movement in order to compensate for any relative movement owing to bending forces.

Naturally, the grinding table may also have its own drive in addition to the grinding roller(s). The distribution of the drive power over a plurality of drives has the advantage that it is possible to use drives which are smaller and therefore cheaper.

According to a preferred embodiment, the pivot axis of the pivot lever is arranged upstream of the grinding roller axis in the direction of rotation of the grinding table. The roller mill further comprises at least one pressing system which is in operational contact with the pivot lever in order to adjust the pressing pressure of the grinding roller.

BRIEF DESCRIPTION OF THE DRAWINGS

Other advantages and constructions of the invention will be explained in greater detail below with reference to the description and the drawings, in which.

DETAILED DESCRIPTION OF THE INVENTION

Figure 1A:
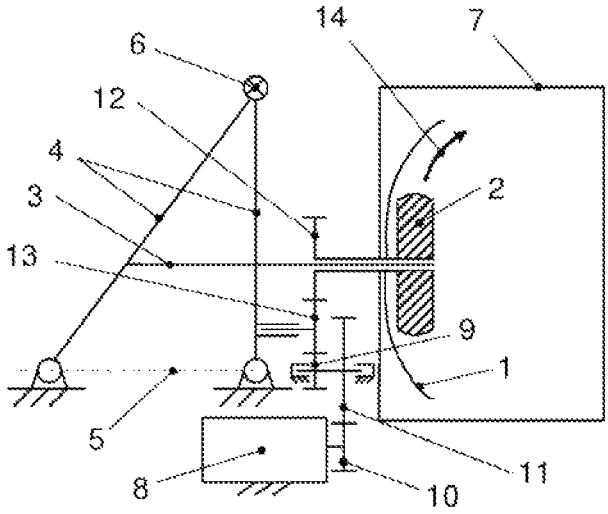
FIG. 1*a* is a schematic top view of a roller mill according to a first embodiment.
Figure 1B:
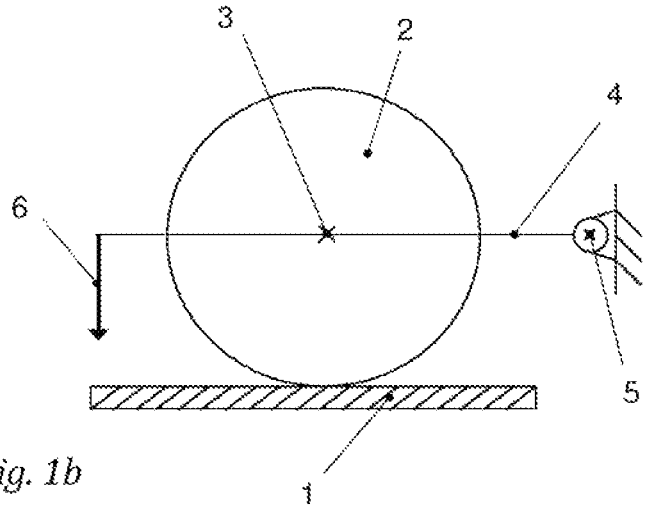
FIG. 1*b* is a schematic side view of the first embodiment.

The roller mill illustrated in FIGS. 1*a* and 1*b* substantially comprises a grinding table 1 which is arranged for rotation about a mill axis, at least one grinding roller 2 which can be rotated about a grinding roller axis 3 and which is in rolling engagement with the grinding table, and at least one pivot lever 4 for retaining the grinding roller 2. The pivot lever has a pivot axis 5, the pivot axis being orientated parallel with the grinding roller axis 3.

At least one pressing system 6 which is in operational contact with the pivot lever 4 is further provided in order to adjust the pressing pressure of the grinding roller. That pressing system can be formed, for example, by a hydropneumatic resilient system.

Whereas the grinding table and the grinding roller are arranged inside a mill housing 7, the pivot lever is advantageously arranged outside the mill housing. In order to drive the grinding roller 2, there is provided a motor 8 which is arranged so as to be fixed in position and which is connected to the grinding roller 2 via a fixed drive train and a drive train which is movable with the pivot lever 4. In this instance, the fixed drive train has a drive element 9 which is in contact with the movable drive train and which is arranged coaxially relative to the pivot axis 5 of the pivot lever 4. That drive element 9 is driven by the motor 8 via toothed wheels 10, 11. The movable drive train has a toothed ring 12 which is connected to the grinding roller 2 and which is in operational connection with the drive element 9 directly or, as illustrated, via an intermediate wheel 13. The drive element 9 and/or the intermediate wheel 13 and the toothed ring 12 may be retained for pivoting movement in order to be able to compensate for any bending stresses of the pivot lever or the grinding roller axis.

The spacing between the grinding roller axis 3 and the axis of the drive element 9 also does not change when the pivot lever 4 moves owing to the coaxial arrangement of the drive element 9 so that reliable transmission of the drive power is ensured.

For the comminution, it is advantageous for the pivot axis of the pivot lever 4 to be arranged upstream of the grinding roller axis 3 in the direction of rotation 14 of the material. There are preferably provided in the roller mill a plurality of grinding rollers, in particular two, four or six grinding rollers, which can each have an individual drive. It may further be advantageous to provide the grinding table with an individual drive.

Instead of the drive power being transmitted via the drive element 9, the intermediate wheel 13 and the toothed ring 12, it would also be possible to provide a traction mechanism whose drive wheel would again have to be arranged coaxially relative to the pivot axis 5. In place of the traction mechanism, however, it would also be possible to provide a bevel wheel mechanism. The drive element 9 would then be intended to be constructed as a bevel wheel which is again arranged coaxially relative to the pivot axis 5.

Figure 2A:
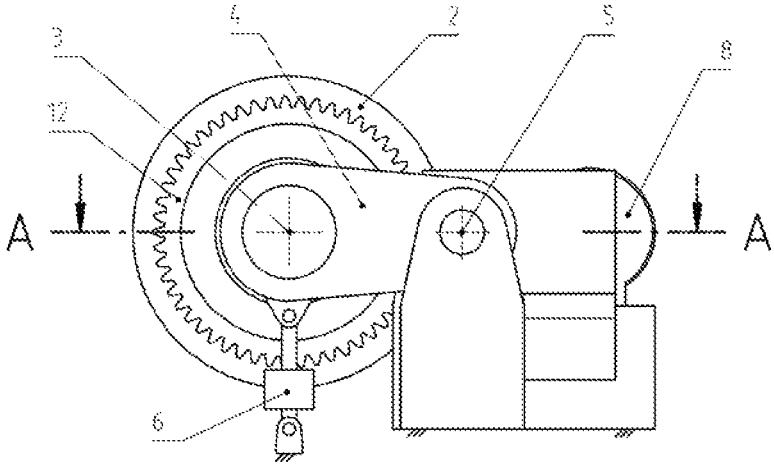
FIG. 2*a* is a side view of a roller mill according to a second embodiment.
Figure 2B:
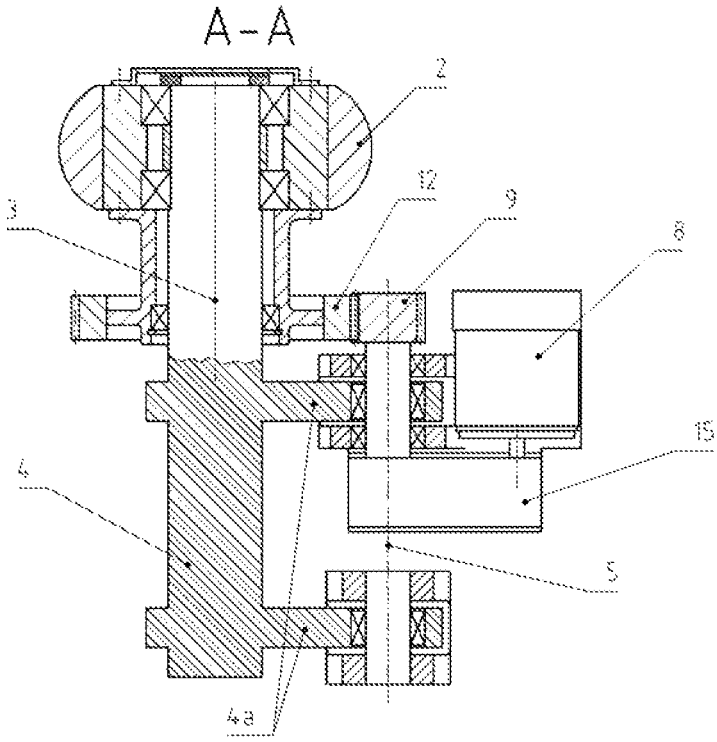
FIG. 2*b* is a sectional illustration taken along line A-A of FIG. 2*a*.

In the second embodiment according to FIGS. 2*a* and 2*b*, the drive element 9 is formed by a pinion gear which is arranged coaxially relative to the pivot axis 5 and which engages with the toothed ring 12. The intermediate wheel 13 according to FIG. 1*a* has been dispensed with in this instance. The motor 8 drives the pinion gear 9 via a gearing mechanism 15, for example, a toothed wheel mechanism step. The motor 8 is constructed in such a manner that the fixed drive train is redirected through 180°.

The pivot lever 4 has two pivot arms 4*a* which fix the grinding roller axis 3 and which are arranged for pivoting movement about the pivot axis 5. The pressing system 6 functions in this instance under tension and may be constructed as a hydropneumatic resilient system. That arrangement results in a very compact drive system for the grinding roller 2.

Although the parallel arrangement of the grinding roller axis 3 and the pivot axis 5 is preferable, in principle it is also conceivable to have an inclined arrangement of the grinding roller axis 3 and the pivot axis 5. An inclined arrangement is intended to include all orientations of the grinding roller axis 3 relative to the pivot axis 5 that are not parallel and not perpendicular relative to each other.

Figure 3:
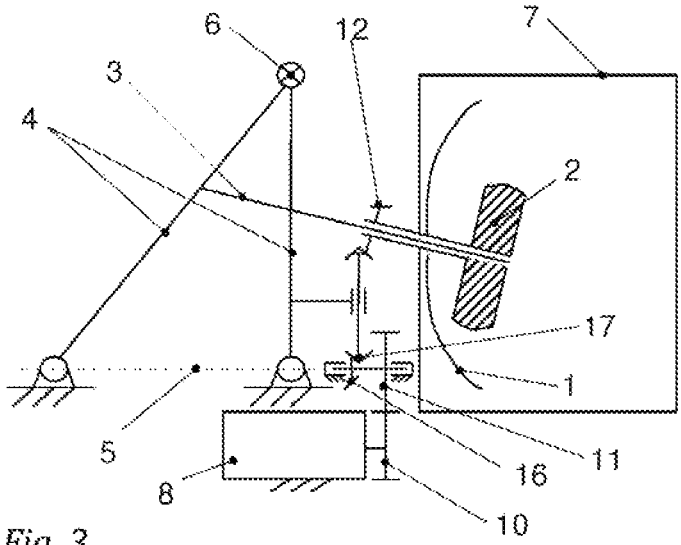
FIG. 3 is a schematic illustration of a roller mill according to a third embodiment.
Figure 4:
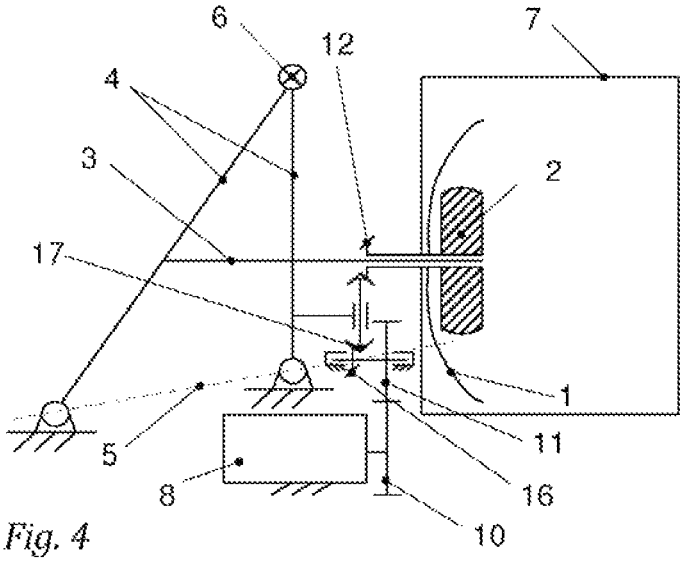
FIG. 4 is a schematic illustration of a roller mill according to a fourth embodiment and FIG. 5 is a schematic illustration of a roller mill according to a fifth embodiment.
Figure 5:
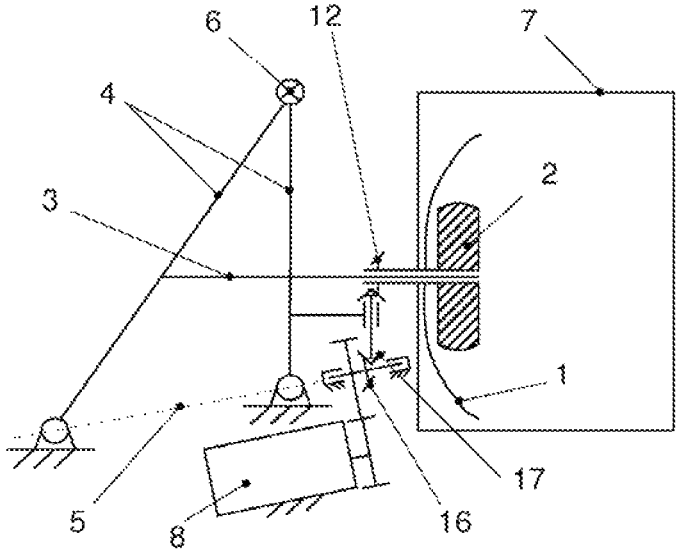

FIGS. 3 to 5 illustrate three different embodiments of such an inclined arrangement. In all the examples, the fixed drive train and the movable drive train are connected to each other via two bevel wheels 16, 17, the bevel wheels being arranged in such a manner that the axes of the bevel wheels intersect with each other in the pivot axis 5.

In the embodiments according to FIGS. 3 and 5, the bevel wheel 16 of the fixed drive train is still orientated coaxially relative to the pivot axis 5. In the embodiment according to FIG. 3, the grinding roller axis 3 has been arranged in an inclined manner whereas, in the embodiment according to FIG. 5, the pivot axis 5 has been rotated in relation to the grinding roller axis. In the embodiment according to FIG. 4, the axis of the bevel wheel 16 is orientated parallel with the grinding roller axis 3.

In all three cases, the axes of the associated bevel wheels 16, 17 intersect in the pivot axis 5 and thereby also ensure reliable transmission of the drive power when the grinding roller axis 2 and the pivot axis 5 are arranged in an inclined manner. In this variant, the bevel wheels can also be retained for pivoting movement.

Even though the drive power is distributed over a plurality of motors, they have a substantial weight so that it is advantageous, specifically with respect to the configuration of the pivot lever and the bearing and control thereof, if the motor and optionally a portion of the gearing mechanism is/are arranged in a fixed manner. It is thereby also possible to dissipate any torque readily via the base.

Owing to the above-described arrangement of the drive element which is in contact with the movable drive train, however, it is also possible to ensure reliable transmission of the drive power in a motor which is fixed in position.

The invention claimed is:

1. Roller mill comprising:

a. a grinding table which is arranged for rotation about a mill axis, b. at least one grinding roller which can be rotated about a grinding roller axis and which is in rolling engagement with the grinding table, c. at least one pivot lever which is for retaining the grinding roller and which has a pivot axis, the pivot axis being oriented parallel with or inclined relative to the grinding roller axis, d. and having at least one motor which is arranged in a fixed manner for driving the roller mill, characterised in that the motor which is arranged in a fixed manner is connected to the grinding roller via a drive train in order to transmit the drive power, the drive train comprising a drive train which is fixed in position and a drive train which is also movable with the pivot lever and the fixed drive train having a drive element which is in contact with the movable drive train and which is arranged coaxially relative to the pivot axis of the pivot lever.

2. Roller mill according to claim 1, characterised in that the movable drive train has a toothed ring which is connected to the grinding roller.

3. Roller mill according to claim 1, characterised in that the drive element is in engagement with the toothed ring.

4. Roller mill according to claim 1, characterised in that the drive element is in operational connection with the toothed ring via at least one intermediate wheel.

5. Roller mill according to claim 4, characterised in that the intermediate wheel is retained on the pivot lever.

6. Roller mill according to claim 1, characterised in that the drive element and/or elements of the movable drive train are retained for pivoting movement.

7. Roller mill according to claim 1, characterised in that the drive element is a drive wheel of a traction mechanism which is provided between the fixed drive train and the movable drive train.

8. Roller mill according to claim 1, characterised in that the pivot axis of the pivot lever is arranged upstream of the grinding roller axis in the direction of rotation of the material.

9. Roller mill according to claim 1, characterised in that the roller mill further comprises at least one pressing system which is in operational contact with the pivot lever in order to adjust the pressing pressure of the grinding roller.

10. Roller mill according to claim 1, characterised in that the roller mill has a mill housing and the pivot lever is arranged outside the mill housing.

11. Roller mill according to claim 1, characterised in that, in addition to the grinding roller, the grinding table also has an individual drive.

12. Roller mill comprising:

a. a grinding table which is arranged for rotation about a mill axis, b. at least one grinding roller which can be rotated about a grinding roller axis and which is in rolling engagement with the grinding table, c. at least one pivot lever which is for retaining the grinding roller and which has a pivot axis, the pivot axis being oriented parallel with or inclined relative to the grinding roller axis, d. and having at least one motor which is arranged in a fixed manner for driving the roller mill, characterised in that the motor which is arranged in a fixed manner is connected to the grinding roller via a drive train in order to transmit the drive power, the drive train comprising a drive train which is fixed in position and a drive train which is movable with the pivot lever and the two drive trains being connected to each other via two bevel wheels, the bevel wheels being arranged in such a manner that the axes of the bevel wheels intersect in the pivot axis.

13. Roller mill according to claim 12, characterised in that the drive element and/or elements of the movable drive train are retained for pivoting movement.

14. Roller mill according to claim 12, characterised in that the pivot axis of the pivot lever is arranged upstream of the grinding roller axis in the direction of rotation of the material.

15. Roller mill according to claim 12, characterised in that the roller mill has a mill housing and the pivot lever is arranged outside the mill housing.

* * * * *